US008056620B2

(12) United States Patent
Tubel

(10) Patent No.: US 8,056,620 B2
(45) Date of Patent: Nov. 15, 2011

(54) LOW COST RIGLESS INTERVENTION AND PRODUCTION SYSTEM

(75) Inventor: Paulo Tubel, The Woodlands, TX (US)

(73) Assignee: Tubel, LLC, The Woodlands, TX (US)

( * ) Notice: Subject to any disclaimer, the term of this patent is extended or adjusted under 35 U.S.C. 154(b) by 316 days.

(21) Appl. No.: 12/463,523

(22) Filed: May 11, 2009

(65) Prior Publication Data

US 2010/0230090 A1 Sep. 16, 2010

Related U.S. Application Data

(60) Provisional application No. 61/159,589, filed on Mar. 12, 2009.

(51) Int. Cl.
*E21B 43/00* (2006.01)

(52) U.S. Cl. ..... 166/68; 166/68.5

(58) Field of Classification Search ..... 166/68, 166/68.5

See application file for complete search history.

(56) References Cited

U.S. PATENT DOCUMENTS

| | | | | |
|---|---|---|---|---|
| 7,498,509 | B2 * | 3/2009 | Brotzell et al. | 174/21 R |
| 7,670,451 | B2 * | 3/2010 | Head | 156/293 |
| 7,762,344 | B2 * | 7/2010 | Courville et al. | 166/387 |

* cited by examiner

*Primary Examiner* — William P Neuder
(74) *Attorney, Agent, or Firm* — Gary R. Maze; Peter B. Scull; Berenbaum Weinshienk PC

(57) ABSTRACT

A system which may be used to replace workover rigs and metallic pipes for the production of hydrocarbon from wellbores uses a non-metallic, substantially continuous, flexible tube comprising a flexible, non-metallic, e.g. resin-based, substantially continuous production tube that can be wellbore deployed and retrieved without the need of onsite rigs. The system's components can be placed inside existing pipes for work in old wells where removal of the existing tube is not economical. The tubes may also be spoolable, thereby increasing installation rates and flexibility. Connectors for the tube may be dimensioned and configured to allow for providing and/or sealing downhole tools to the production tube. In certain embodiments, an onsite power generator will provide a clean alternative to existing diesel burning generators and will typically use a furnace, boiler, steam engine and electrical power generator.

19 Claims, 5 Drawing Sheets

LOW COST RIGLESS INTERVENTION AND PRODUCTION SYSTEM

RELATION TO OTHER APPLICATIONS

This application claims the benefit of U.S. Provisional Application No. 61/159,589, filed on Mar. 12, 2009.

BACKGROUND OF THE INVENTION

Currently, deployment and retrieval of downhole devices such as pumps and production pipes requires a rig, which can be costly. Further, wellbore tubulars tend to be made of metals which may corrode and are rigid, leading to less flexible installation procedures.

Over the past 10 years, the application of non-metallic materials in flowlines such as in those used wellbores has proven itself an alternative to metallic flowlines. Metallic materials tend to be less resistant to corrosion and/or chemicals and their rigidity is a factor to be taken into consideration during installation and use.

SUMMARY

A system is disclosed that uses a non-metallic, substantially continuous, flexible tube comprising a flexible, non-metallic, e.g. resin-based, substantially continuous production tube that can be wellbore deployed and retrieved without the need of on site rigs. Reusability is enhanced since the tube can be retrieved and redeployed in the wellbore. The system's components can be placed inside existing pipes for work in old wells where removal of the existing tube is not economical.

Non-metallic materials such as thermoplastics have high chemical resistance, depending on material chosen, and are typically imperative to corrosion. Tubes comprising such non-metallic materials may also be spoolable, thereby increasing installation rates and flexibility. Such systems may also require fewer personnel and less time to deploy equipment and tube in a well. Systems as claimed herein can be easily insulated for special applications.

Connectors for the tube are dimensioned and configured to allow for sealing the downhole tools to the production tube. Additionally, an interface to a tool such as a downhole pump may be provided to allow downhole processes, e.g. dewatering and/or chemical injection.

The system may be used to replace workover rigs and metallic pipes for the production of hydrocarbon from wellbores.

In certain embodiments, an onsite power generator will provide a clean alternative to existing diesel burning generators and will typically use a furnace, boiler, steam engine and electrical power generator.

BRIEF DESCRIPTION OF THE DRAWINGS

The various drawings supplied herein are representative of one or more embodiments of the present inventions.

DETAILED DESCRIPTION OF EXEMPLARY EMBODIMENTS

As used herein, "tube" will be understood by one of ordinary skill in these arts to include a production pipe, an injection pipe, a portion of a tubular to be used within a wellbore, a portion of a tubular to be used within another tubular, or the like.

Figure 1:
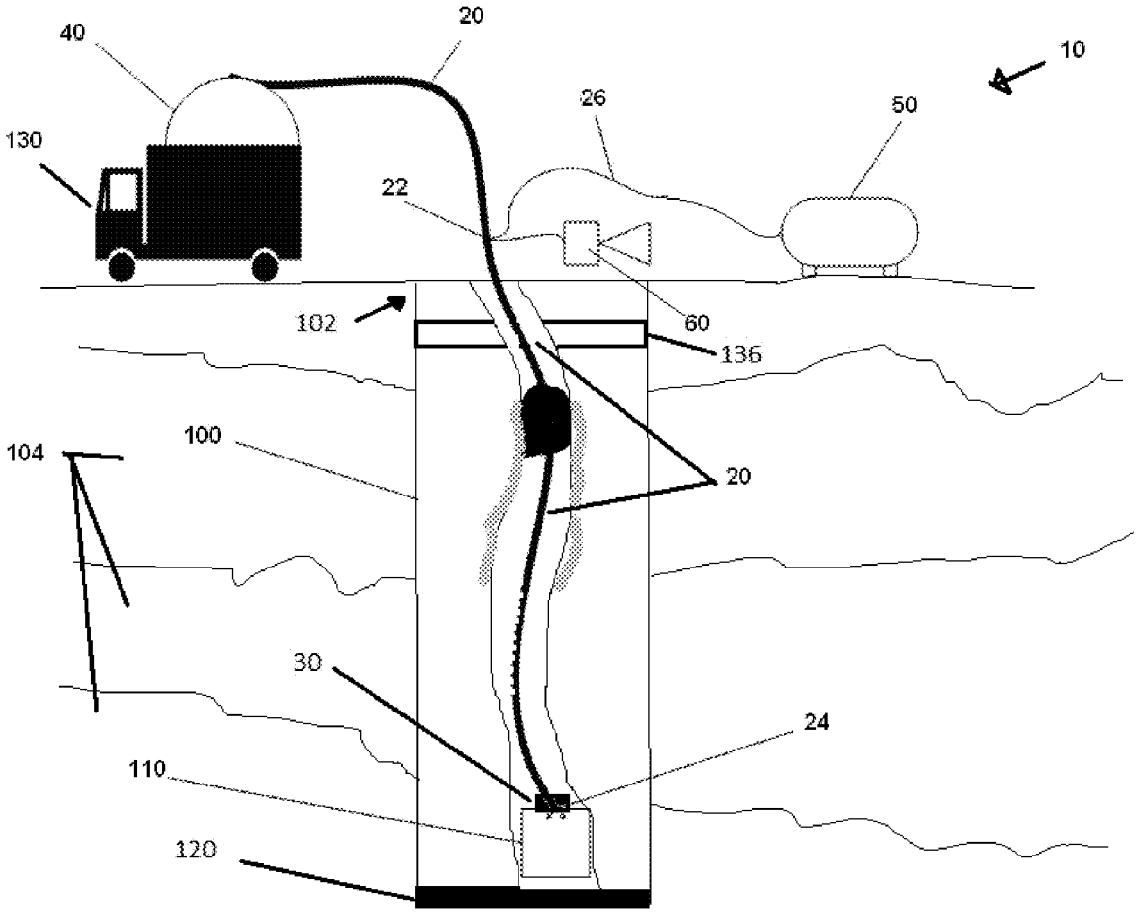
FIG. 1 is a diagram of an exemplary system embodiment.

Referring now to FIG. 1, rigless intervention and production system 10 comprises flexible, non-metallic, substantially continuous tube 20 and connector 30.

Tube 20 comprises a high temperature tolerant, non-metallic material such as a carbon-enhanced, resin-based thermoplastic, a fluoropolymer, a polyemide material, or the like, or a combination thereof. Kevlar® or other similar materials may be used as part of the tube wall to strengthen tube 20 such as to improve pressure collapse and burst properties.

In typical embodiments, a predetermined portion of tube 20 is dimensioned and configured to be deployed within wellbore 100, with the predetermined portion of tube 20 further comprising first connection end 24 disposed distally from fluid outlet 22. Tube 20 is typically dimensioned and configured into continuous lengths to reach a desired wellbore depth, typically from around between 6,000 feet to around 10,000 feet. In typical embodiments, tube 20 can withstand a maximum working pressure of around 15,000 psi (1,034 bar).

Figure 2:
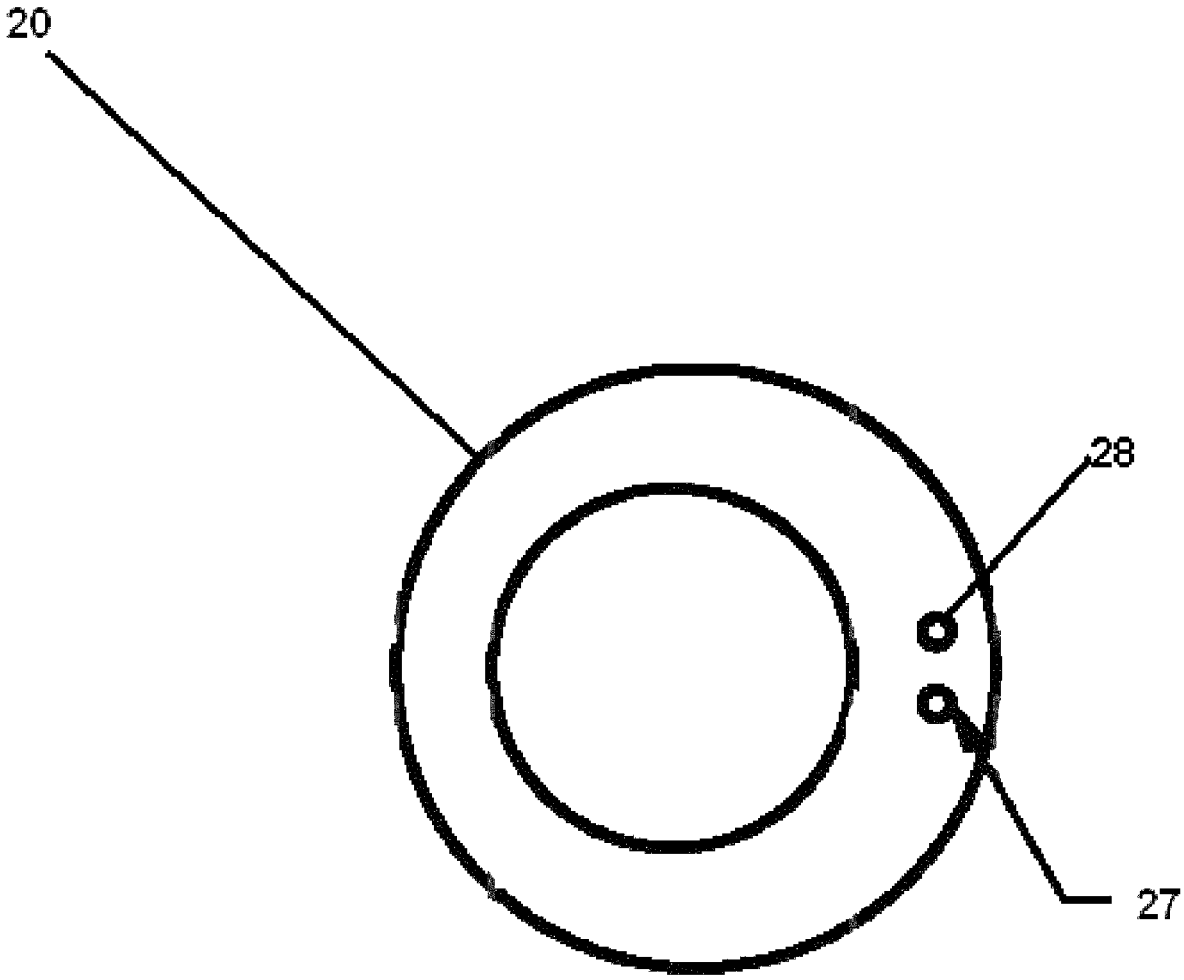
FIGS. 2 and 3 are perspectives in partial cutaway of an exemplary tube illustrating embedded umbilical and/or electrical cables.
Figure 3:
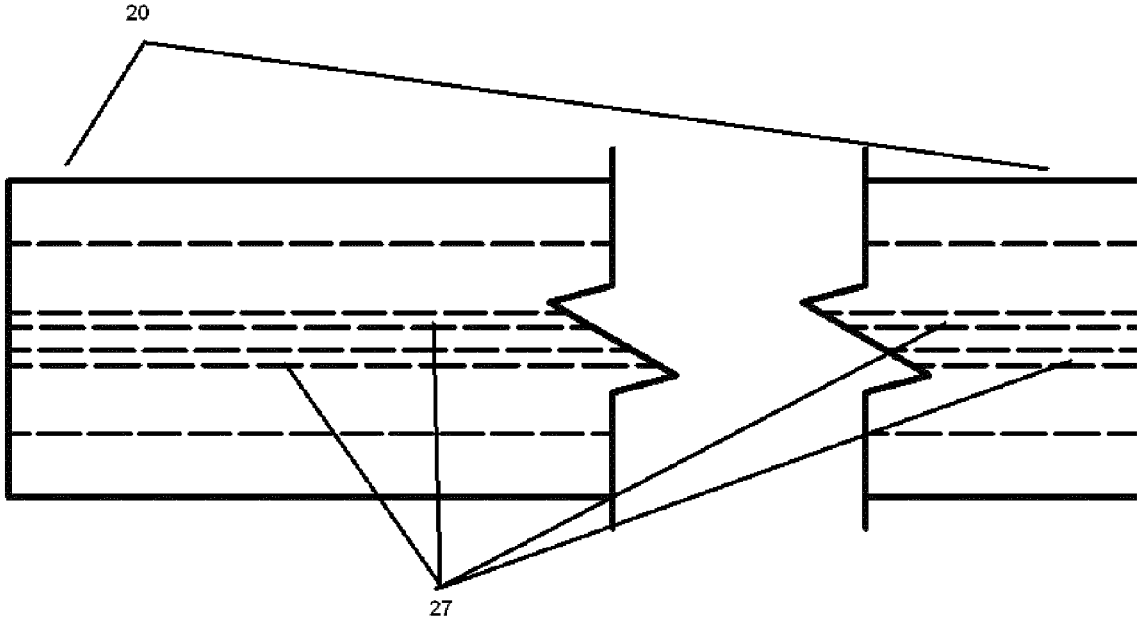

Referring additionally to FIGS. 2 and 3, tube 20 may further comprise umbilical 26 and/or electrical cable 27 which may be disposed about a predetermined portion of tube 20, such as about an interior or exterior surface of tube 20, or at least partially embedded into tube 20. In certain configurations, umbilical 26 may further comprise electrical cable 27.

Annulus 28 of tube 20 is typically dimensioned and configured to allow fluids to be pumped into wellbore 100.

Connector 30 is typically attached to first connection end 24 and dimensioned and configured to sealably attach tube 20 to tool 110 which is deployable within wellbore 100, e.g. pump 110*a* (not specifically shown in the figures), downhole gauge 110*b* (not specifically shown in the figures), sensors 110*c* (not specifically shown in the figures), or the like, or a combination thereof. Tools 100 such as downhole gauge 110*b* may be used to optimize production from wellbore 100. For example, downhole gauge 110*b* may be dimensioned and configured to measure pressure of injected water near the bottom of wellbore 100, temperature of injected water near the bottom of wellbore 100, or the like, or a combination thereof. As used herein, "wellbore" and "well" may be used synonymously, as the context requires.

Sensors 110*c* may be embedded into tube 20 such as during the manufacturing process. These sensors 110*c* may comprise induction system sensors for formation evaluation and fluid evaluation; radio frequency identification sensors (RFID); pressure and temperature sensors, or the like, or combinations thereof. Sensors 110*c* may be operatively connected to cable 27, e.g. using wired or wireless connections, umbilical 26, or to a cable disposed outside tube 20. Fiber wire 28 may also be embedded or otherwise disposed inside tube 20 and used for sensing downhole data such as data regarding production status, fluid configuration, fluid flow, fluid density, microseismic data, strain, pressure, temperature, or the like, or a combination thereof. As will be apparent to one of ordinary skill in these arts, sensor 110*c* may be a plurality of sensors 110*c* embedded at a corresponding plurality of locations in tube 20 or gathered into less than a corresponding plurality of locations in tube 20. Sensors 110*c* may further comprise one or more coils dimensioned and configured to provide formation evaluation data, data communications, or the like, or a combination thereof.

In certain embodiments, tube spooler 40 is operatively connected to tube 20, i.e. tube 20 may be spooled and/or unspooled from tube spooler 40. Tube spooler 40 may comprise a power cable spooler or a combination of a power cable and a tube spooler.

Vehicle 130 may be part of rigless intervention and production system 10 and dimensioned and configured to accept tube spooler 40. One or more tube spoolers 40 and/or power cable spoolers may be located in the same unit for deployment, e.g. vehicle 130.

In currently contemplated embodiments, vehicle 130 comprises mast 132 and controller 134. Controller 134 is operatively in communication with tube spooler 40. Controller 134 controls the tension on tube 20, depth of tube 20 into wellbore 100, as well as control the starting and stopping of tube spooler 40. Controller 134 may be an electro-hydraulic controller, an electronic controller, or the like, or a combination thereof.

Rigless intervention and production system 10 may further comprise power generator 50. Typically, power generator 50 is a steam-powered electricity generator disposed at or near a surface location of wellbore 100. Power generator 50 may be in fluid connection with fluid outlet 22 to allow use of water from wellbore 100 obtained through fluid outlet 22 to be turned into steam to provide power for power generator 50. In currently envisioned embodiments, power generator 50 may be dimensioned and configured to use natural gas to generate heat to boil the water into steam for use by power generator 50. The water and natural gas may be obtained from wellbore 100, transported from a remote location, or the like, or a combination thereof.

Injector 60 may be present and operatively in fluid communication with tube 20 and used at wellhead 102 for the deployment of the system in wellbore 100. In these embodiments, injector 60 is dimensioned and configured for injection of fluids into wellbore 100 from the surface through a predetermined portion of tube 20. These fluids are typically usable for water injection suitable for well desalination or chemical injection.

Tube stop 120, which may include devices such as packers, may be deployed in wellbore 100 to secure tube 20 to a predetermined location in wellbore 100, such as near well perforations.

In further embodiments, a tool such as packoff unit 136 or tube hanger (not shown in the figures) is dimensioned and adapted to secure tube 20 inside wellbore 100 near wellhead 102. Tool 136 would typically be attached to the casing wall.

In certain embodiments, tube 20 further comprises a material disposed about an outer surface of tube 20. This material may be disposed along one or more predetermined lengths of tube 20 that match predetermined geological zone 104 in wellbore 100 that needs to be isolated. The material is configured and adapted to swell when in contact with a fluid, such as hydrocarbon or other fluids such as water, such that the material swells and seals the area between the outside of flexible non-metallic continuous tube 20 and well casing 104 or a geological formation when the material gets in contact with the activating fluid. For embodiments where the geographical zone comprises a plurality of zones in wellbore 100, the material may be disposed along different lengths of tube 20 where each such length matches one of the geological zones. This configuration can be used to isolate a zone in wellbore 100 where metallic production tube may be leaking. In this case, tube 20 can be deployed through the production tube and the production would then continue through tube 20 as opposed to the original production tube.

By way of example and not limitation, in certain embodiments, isolation material such as rubber formation isolation material can be attached to packoff unit 136, tube 20, or both, either permanently or removably. This material may be swell when in contact with a fluid, such as hydrocarbon or other fluids such as water, such that the material swells and seals the area between the outside of flexible non-metallic continuous tube 20 and well casing 104 or a geological formation when the material gets in contact with the activating fluid.

In the operation of preferred embodiments, rigless intervention and production system 10 may be used for wellbore operations.

In one exemplary embodiment, rigless intervention and production system 10 is used for dewatering by deploying a predetermined portion of a flexible, non-metallic, substantially continuous tube 20 within wellbore 100; attaching first connection end 24 to pump 110*a*; and using pump 110*a* to introduce water from wellbore 100 into an annulus of tube 20. Pump 110*a* may be attached to first connection end 24 prior to deploying tube 20 and pump 110*a* into wellbore 100.

In a further exemplary embodiment, power generator 50, which is in fluid communication with the annulus of tube 20, may be used to generate electricity using water introduced to power generator 50 via tube 20.

Once so deployed, production of hydrocarbons through the annulus of tube 20 may be allowed. Further, water or chemicals may be injected into wellbore 100 through tube 20.

Figure 4:
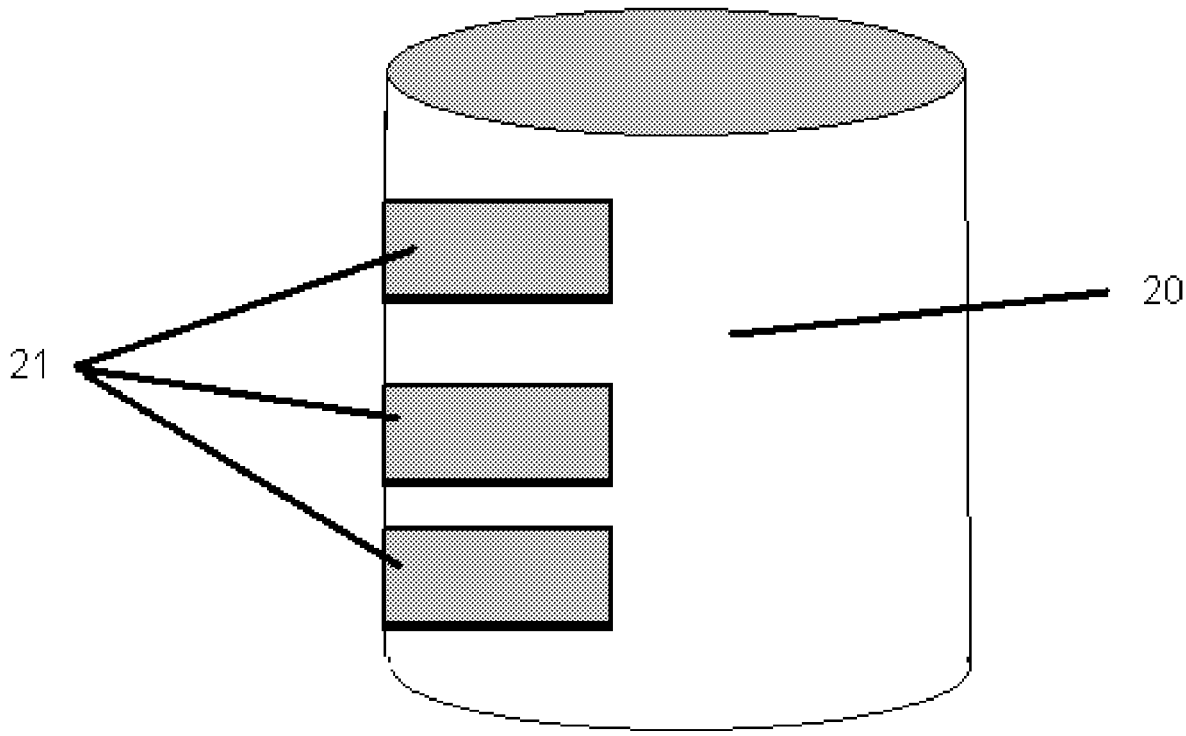
FIG. 4 is an exemplary plan view of a tube with filters.

Referring additionally to FIG. 4, in certain contemplated embodiments, control of sand or other particulate matter within wellbore 100 may be accomplished using tube 20 or a portion of tube 20. A control depth of a production pipe within wellbore 100 is determined, where the control depth may be the result of sand or other unwanted solids being present. In these embodiments, tube 20 is fashioned with one or more filters 21 disposed at a predetermined length of tube 20 and then tube 20 deployed into wellbore 100. Filters 21 are dimensioned and adapted to filter a solid such as sand from fluid being produced in wellbore 100. Deploying tube 20 to the control depth positions filter 21 in wellbore 100 at the control depth production of the fluid is the allowed through filter 21, such as into tube 20. Tube 20 with filter 21 may also be a standalone unit deployed with standard metallic pipe.

Figure 5:
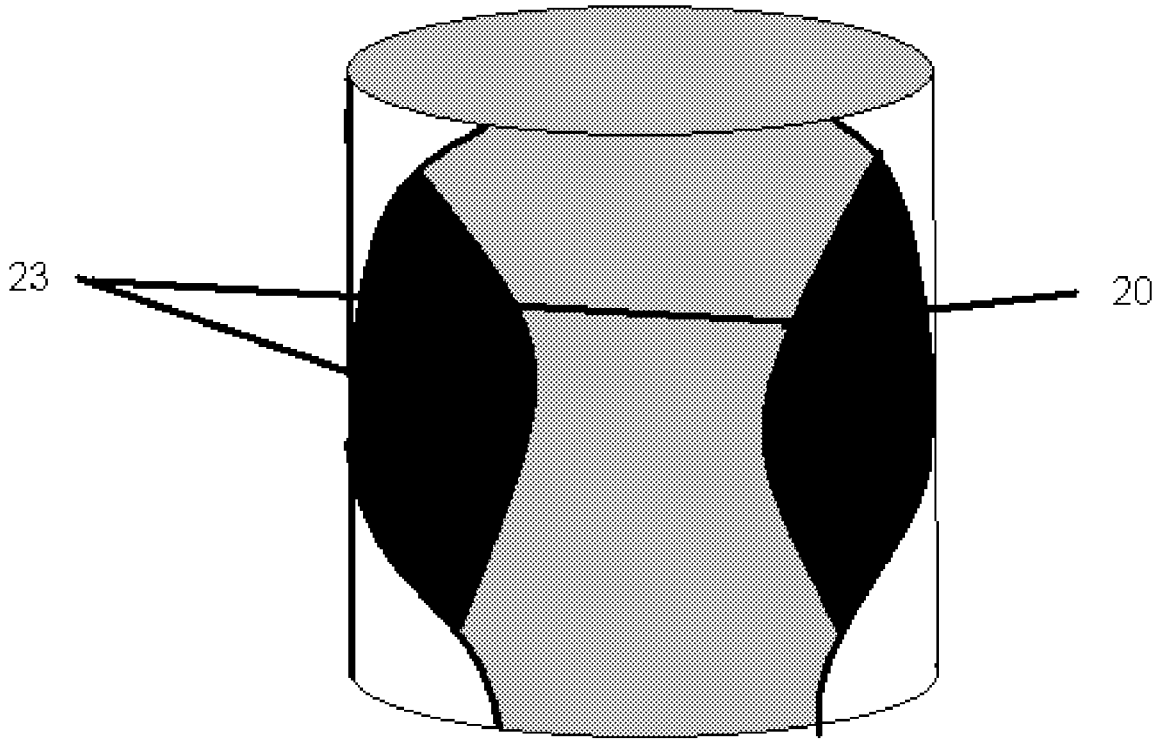
FIG. 5 is an exemplary plan view of a tube with deformable material.

Referring additionally to FIG. 5, in certain contemplated embodiments, tube 20 may further comprise deformable material 23. By way of example and not limitation, piezoelectric material can be molded onto tube 20, which itself may comprise a suitable plastic, and deformed to allow or impede the flow of hydrocarbons into tube 20 when electrical current is exerted onto the material. The piezoelectric material may be enhanced with nanotubes dimensioned and configured to control the flow of fluids being produced in wellbore 100. Tube 20 with deformable material 23 may also be a standalone unit deployed with standard metallic pipe.

The foregoing disclosure and description of the inventions are illustrative and explanatory. Various changes in the size, shape, and materials, as well as in the details of the illustrative construction and/or a illustrative method may be made without departing from the spirit of the invention.

I claim:

1. A rigless intervention and production system, comprising:

a. a flexible, substantially continuous tube comprising a non-metallic material, a fluid outlet, a first predetermined portion of the tube dimensioned and configured to be deployed within a wellbore, the first predetermined portion of the tube further comprising a first connection end disposed distally from the fluid outlet;

b. a connector attached to the first connection end, the connector dimensioned and configured to sealably attach to a tool deployable within the wellbore;

c. a pump in fluid communication with the tube; and d. a material disposed about an outer surface of a second predetermined portion of the tube, the material configured and adapted to swell when in contact with a predetermined activating fluid.

2. The rigless intervention and production system of claim 1, wherein the non-metallic material comprises a high temperature non-metallic material.

3. The rigless intervention and production system of claim 1, wherein the non-metallic material comprises at least one of (i) a carbon-enhanced, resin-based thermoplastic, (ii) a fluoropolymer, or (iii) polyemide material.

4. The rigless intervention and production system of claim 1, wherein the tube wall of the tube further comprises a strengthening material dimensioned and adapted to strengthen the tube for at least one of pressure collapse properties and burst properties.

5. The rigless intervention and production system of claim 1, further comprising a power generator in fluid connection with the fluid outlet.

6. The rigless intervention and production system of claim 5, wherein the power generator comprises a steam-powered electricity generator in fluid communication with the fluid outlet, the power generator further dimensioned and configured to use water from the wellbore obtained through the fluid outlet.

7. The rigless intervention and production system of claim 6, wherein the power generator is further dimensioned and configured to use natural gas to generate heat to boil the water into steam for the steam power generator.

8. The rigless intervention and production system of claim 5, wherein the power generator is disposed at a surface location.

9. The rigless intervention and production system of claim 5, further comprising:

a. a tube spooler dimensioned and adapted to spool and unspool the tube;

b. a power cable spooler dimensioned and adapted to spool and unspool a power cable, the power cable operatively connected to the power generator; and c. a deployment surface system;

d. wherein the tube spooler and power cable spooler are co-located in the same unit for deployment.

10. The rigless intervention and production system of claim 1, further comprising a fluid injector in fluid communication with the fluid outlet.

11. The rigless intervention and production system of claim 10, wherein the fluid injector is dimensioned and adapted to inject water suitable for well desalination.

12. The rigless intervention and production system of claim 1, further comprising:

a. a cable disposed about a third predetermined portion of the tube, the cable comprising at least one of (i) an electrical cable at least partially embedded into the tube or (ii) a fiber optic cable at least partially embedded into the tube; and b. a sensor operatively connected to the cable.

13. The rigless intervention and production system of claim 12, wherein the sensor is at least partially embedded in the tube.

14. The rigless intervention and production system of claim 12, wherein the sensor comprises a gauge.

15. The rigless intervention and production system of claim 14, wherein the gauge is to be deployable in the wellbore and dimensioned and configured to measure at least one of pressure or temperature of injected water near the bottom of the well.

16. The rigless intervention and production system of claim 1, further comprising:

a. a tube stop deployed in the wellbore to secure the tube to a predetermined location in the wellbore; and b. a packoff unit dimensioned and adapted to secure the tube inside the wellbore near the wellhead, the packoff unit dimensioned and adapted to be connected to a well casing near the wellhead.

17. The rigless intervention and production system of claim 1, further comprising a deformable material at a third predetermined portion of the tube, the deformable material dimensioned and adapted to control fluid flow within the tube.

18. The rigless intervention and production system of claim 17, wherein the deformable material comprises a piezoelectric flexible material dimensioned and adapted to allow control of fluids flowing into and out from the tube.

19. A rigless intervention and production system, comprising:

a. a flexible, substantially continuous tube comprising a non-metallic material, a fluid outlet, a first predetermined portion of the tube dimensioned and configured to be deployed within a wellbore, the first predetermined portion of the tube further comprising a first connection end disposed distally from the fluid outlet, and a tube wall of the tube, the tube wall further comprising a strengthening material dimensioned and adapted to strengthen the tube for at least one of pressure collapse properties and burst properties;

b. a connector attached to the first connection end, the connector dimensioned and configured to sealably attach to a tool deployable within the wellbore;

c. a material disposed about an outer surface of a second predetermined portion of the tube, the material configured and adapted to swell when in contact with a predetermined activating fluid.

* * * * *